US006223014B1

(12) United States Patent
Niwano et al.

(10) Patent No.: US 6,223,014 B1
(45) Date of Patent: Apr. 24, 2001

(54) DEVELOPER-REGULATING MEMBER, DEVELOPMENT DEVICE, PROCESS CARTRIDGE, AND PROCESS FOR PRODUCING DEVELOPER-REGULATING MEMBER

(75) Inventors: Kentaro Niwano, Yamato; Susumu Shimada, Tsukuba; Masaaki Kumamura, Yokohama; Masahiro Watabe, Yokohama; Kenichi Sakai, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/241,306

(22) Filed: Feb. 1, 1999

(30) Foreign Application Priority Data

Feb. 3, 1998 (JP) ..... 10-021897

(51) Int. Cl.[7] ..... G03G 15/08
(52) U.S. Cl. ..... 399/284
(58) Field of Search ..... 399/111, 119, 399/222, 265, 274, 284

(56) References Cited

U.S. PATENT DOCUMENTS 4,796,561 * 1/1989 Takano et al. ..... 399/274
4,990,959 * 2/1991 Yamamuro et al. ..... 399/274
5,210,575 * 5/1993 Kikuchi ..... 399/284
5,321,472 * 6/1994 Adachi et al. ..... 399/174
5,353,104 * 10/1994 Kato et al. ..... 399/274
5,485,254 * 1/1996 Bogoshian et al. ..... 399/274
5,510,887 4/1996 Watabe et al. .
5,548,386 * 8/1996 Fukuda ..... 399/284
5,729,806 * 3/1998 Niwano et al. ..... 399/284
5,863,329 * 1/1999 Yamanouchi ..... 399/274 X
5,893,013 * 4/1999 Kinoshita et al. ..... 399/284
5,895,151 * 4/1999 Kinoshita et al. ..... 399/284

FOREIGN PATENT DOCUMENTS 9-222834 8/1997 (JP) .

* cited by examiner

*Primary Examiner*—Sandra Brase
(74) *Attorney, Agent, or Firm*—Fitzpatrick, Cella, Harper & Scinto

(57) ABSTRACT

A developer-regulating member includes a rubber elastomer blade pressed against the surface of a developer-feeding member and a holder for holding the rubber elastomer blade. The holder is warped in the direction of flattening the face of part of the rubber elastomer blade, that face being pressed against the surface of the developer-feeding member.

13 Claims, 7 Drawing Sheets

DEVELOPER-REGULATING MEMBER, DEVELOPMENT DEVICE, PROCESS CARTRIDGE, AND PROCESS FOR PRODUCING DEVELOPER-REGULATING MEMBER

BACKGROUND OF THE INVENTION

1. Field of the Invention

The present invention relates to the developer-regulating member (member for regulating a thickness of a developing agent) of a development device for visualizing a latent electrostatic image by developing a latent electrostatic image formed on an image-holding member. The present invention relates also to a development device and a process cartridge employing the developer-regulating member, and a process for producing the developer-regulating member.

2. Related Background Art

The developer-regulating member regulates the layer thickness of a developing agent (developer) on a developer-feeding member for carrying the developer onto an electrophotographic sensitive member. More specifically, the developer-regulating member is brought into pressure contact with a developer-feeding member to allow the developer to pass through the gap between the developer-regulating member and the developer-feeding member to form a thin layer on the developer-feeding member, and to give a frictional charge (triboelectric charge) to the developer for developer a latent image.

Elastic blades, as the developer-regulating member, have been proposed in which a rubber blade as the developer-regulating member and a metal holder are integrated into one body.

The elastic blade of such a constitution is produced by injection molding because of the low cost and short time for production. In the injection molding, a holder as a supporting plate is placed in a metal mold, a rubber material is injected into the metal mold, and the injected rubber material is cured by heating. The molding temperature is usually controlled so that the metal mold is kept at 200° C. and a liquid rubber kept at about 30° C. is injected to thermally cure the rubber. In the molding of the rubber elastomer with the metallic holder in integration, a hot adhesion primer is suitably used for improving the adhesion between the less adhesive rubber, such as a silicone rubber, and the metal.

The conventional developer-regulating member may cause irregularity in the image density owing to nonuniform pressure contact of the rubber elastomer with a developer-feeding member. This nonuniform contact results from the two causes discussed below.

The first cause is now described. In the integral injection molding, the rubber elastomer warps convexly along the lengthwise direction as shown in FIG. 2 by the upper arrow mark. The contact portion to be brought into pressure contact with a developer-feeding member is warped convexly because the linear expansion coefficient of the rubber elastomer is significantly different from that of the metallic holder. A steel plate has a linear expansion coefficient of $10\times10^{-6}$, whereas a thermosetting liquid silicone rubber, a typical rubber material for the developer-regulating member, has a linear expansion coefficient of $77\times10^{-6}$. Therefore, the dimension of thermal contraction differs between the metallic holder and the rubber elastomer blade to cause deformation of the rubber elastomer blade integrated with the metallic holder. Furthermore, in curing of the rubber elastomer, internal stress becomes nonuniform to also cause deformation of the rubber elastomer.

Further, the cross-sectional shape of the rubber elastomer blade at a plane perpendicular to the lengthwise direction of the development blade is not symmetrical, the shape thereof at the toner container side being different from the shape at the side of contact with the developer-feeding member (FIG. 3). Such a shape factor causes the above convex warpage.

In regulating the electric charging and toner application by using such a convexly warped developer-regulating member, the pressure of contact of the rubber blade with the developer-feeding member is higher at both end portions in the lengthwise direction of the developer-feeding member. Thus, in printing with a copying machine or a printer, the toner layer is thinner at the end portions of the sleeve owing to the higher pressure, resulting in a lower density of the formed image at both end portions.

The second cause of the irregularity in image density is now described. One type of the developer-regulating member for suitable control of the contact pressure has the blade thickness varying in the lengthwise direction and in the vertical direction. FIG. 13 shows an example thereof. This developer-regulating member has a slanting face portion of the rubber elastomer at the side reverse to the pressure-contacting side with the thickness of the rubber elastomer increasing toward the metallic holder. In injection molding of the developer-regulating member of such a structure, the molded member warps owing to the linear expansion coefficient difference between the metallic holder and the rubber elastomer. This warpage is caused in two directions, convexly at the side of pressure contact with the developer-feeding member as mentioned above, and concavely as the entire rubber elastomer (shown by the arrow mark in FIG. 13). This warpage at the tip portion of the rubber elastomer can be corrected by cutting to flatten the face. However, the concave warp at the taper portion 7 in FIG. 13 cannot be corrected by machining. With such a developer-regulating member being warped at the taper portion, the contact pressure varies in the lengthwise direction on pressure contact with the developer-feeding member, with higher contact pressure at both end portions of the pressure contact, causing irregularity of the image density at the blade end portions.

From the above two causes, a conventional developer-regulating member causes irregularity in the image density, owing to nonuniform pressure contact of the rubber elastomer blade with the developer-feeding member.

SUMMARY OF THE INVENTION

An object of the present invention is to provide a developer-regulating member for regulating the thickness of a developing agent layer to be pressed at its rubber elastomer blade against a developer-feeding member, that does not cause image density irregularity.

Another object of the present invention is to provide a development device and a process cartridge employing the above developer-regulating member.

A further object of a present invention is to provide a process for producing the developer-regulating member which can be pressed uniformly at its rubber elastomer portion against a developer-feeding member without causing image density irregularity at the end portion of the image.

The developer-regulating member of the present invention is constituted of a rubber elastomer blade pressed against the surface of a developer-feeding member and a holder for holding the rubber elastomer blade, the holder being warped in the direction of flattening the face of the portion of the rubber elastomer blade to be pressed against the surface of the developer-feeding member.

The development device of the present invention includes a developer vessel containing a developer, a developer-feeding member for carrying the developer to a developing part, and a developer-regulating member pressed against the surface of the developer feeding member in the lengthwise direction thereof with interposition of the developer to control the amount of the developer applied. The developer-regulating member is the one mentioned above.

The process cartridge of the present invention is constituted of a photosensitive member, and at least one of an electric charging means, a developing means, and a cleaning means which are integrated into one body, and is demountable from the main body of the imaging-forming apparatus, in which the developing means is the one mentioned above.

The process for producing the developer-regulating member, constituting by a rubber elastomer blade and a holder for holding the rubber elastomer blade in integration, with the thickness of the rubber elastomer blade being tapered in a direction perpendicular to the lengthwise direction, include injection molding the holder placed in a metal mold, whose molding face for the rubber elastomer blade is designed to have a taper dimension smaller at both ends in the lengthwise direction than that of the middle portion, and forming the developer-regulating member with a substantially uniform taper dimension in the lengthwise direction.

In the present invention, the metal holder is warped to flatten the face of the portion of the rubber elastomer blade pressed against the developer-feeding member to make uniform the contact pressure in the lengthwise direction of the rubber elastomer blade. Specifically, when the pressing portion of the rubber elastomer blade warps concavely, the metallic holder is made convex, and when it warps convexly, the metallic holder is made concave, to correct and flatten the pressing face of the rubber elastomer blade.

In this specification, the term "flat" means a state of the pressing face of the rubber elastomer blade such that the developer is pressed uniformly against the developer-feeding member so as not to cause image density irregularity.

In the process of the present invention, the developer-regulating member is produced, with the thickness of the rubber elastomer blade varying in a direction perpendicular to the lengthwise direction, by injection molding with the holder placed in the metal mold, whose molding face for the rubber elastomer blade is designed shorter at both ends in the lengthwise direction than that at the middle portion to offset the rise at both ends of the tapered portion as shown in FIG. 13, whereby the developer-regulating member can be formed with a substantially uniform taper dimension in the lengthwise direction.

The irregularity of the image density caused by the variation of the contact pressure of the rubber elastomer blade of the developer-regulating member against the developer-feeding member is corrected by the above mentioned change in the shape of the metallic holder or a change in the dimension of the taper in the metal mold. The best result can be achieved by combining both of the above corrections.

DESCRIPTION OF THE PREFERRED EMBODIMENTS

The warping direction of the holder is selected to be convex or concave depending on the shape of the rubber elastomer blade, and other conditions. The warping direction is selected so as to offset the warpage of the rubber elastomer blade formed integrally with a nonwarped holder. For example, in the case where the rubber elastomer blade, which has a slant face portion at the side reverse to the side of the pressure contact, becomes warped convexly at the face of the pressure contact side as shown in FIG. 2, the holder is suitably bent concavely as shown by the arrow mark in FIG. 1. As a result the warpage of the rubber elastomer blade caused with the nonwarped holder is offset to result in a flat pressure contact portion.

The holder can be worked as follows. A slitted roll material is leveled in a roll lengthwise direction by a leveler, and is punched. The leveled and punched material is bent at the end portion, and then is bent convexly (or concavely) by a pressing machine. The metal mold for press-bending convexly or concavely may have such a constitution that both ends are fixed and the middle portion is allowed to sink by a spring mechanism. The degree of warpage can be controlled by the degree of the sink and the pressing.

The degree of the warpage of the holder is selected depending on the shape of the rubber elastomer blade, molding conditions, and other conditions such that the rubber elastomer blade is flattened at the portion brought into pressure contact with the developer-feeding member. For example, the direction and degree of the warpage of the holder is decided on the basis of the result of measurement of the degree of warpage of a rubber elastomer blade formed integrally with a nonwarped holder, or on the basis of a experimentally derived dependence of the warpage of the rubber elastomer blade on the warpage of the holder. Otherwise, the direction and degree of the warpage of the holder is decided on the basis of a computer simulation of the direction and degree of the warpage for a model in which the holder and a rubber elastomer blade are integrated into one body.

Insufficient warpage of the holder does not correct sufficiently the resulting warpage of the rubber elastomer blade tip, whereas excessive warpage of the holder may cause deformation of the developer vessel owing to the shape of the holder mounted thereon. Therefore, the degree of the warpage should be selected within the suitable range.

Figure 1:
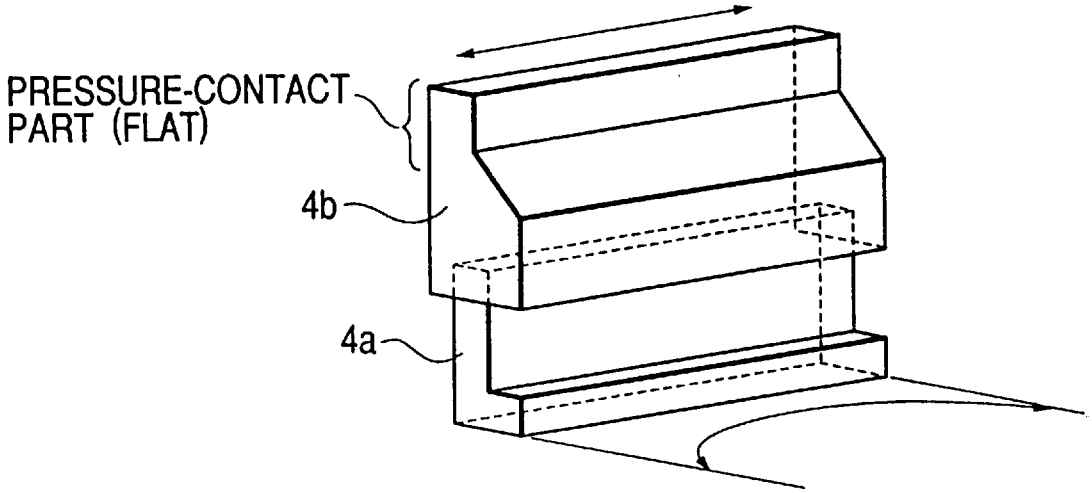
FIG. 1 shows a shape of the developer-regulating member of the present invention.
Figure 2:
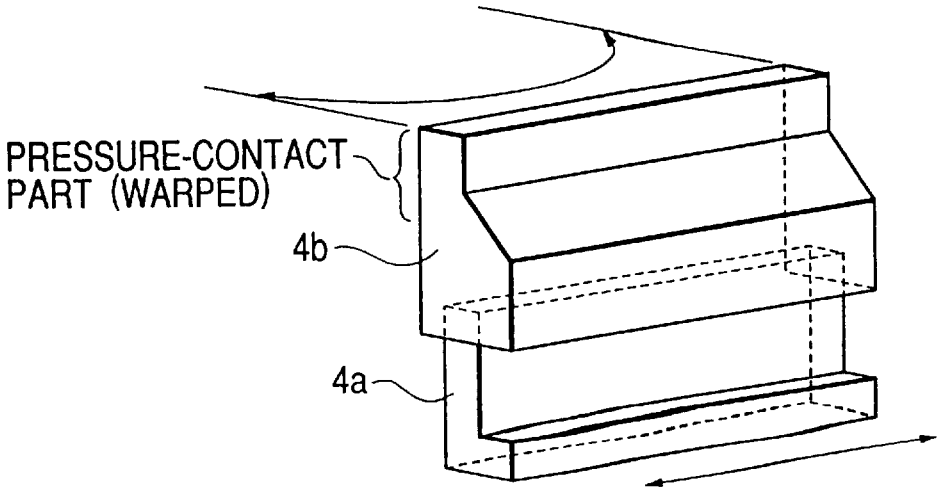
FIG. 2 PRIOR ART
FIG. 2 shows a shape of a conventional developer-regulating member.

For example, for a developer-regulating member having a rubber elastomer blade and a holder as shown in FIG. 1, the warpage of the holder ranges preferably from 0.02 and 0.1 mm, an more preferably from 0.02 to 0.06 mm. Here, the degree of the warpage is measured in such a manner that the holder is fixed on a reference horizontal plane at the holder ends to be fixed to the development device, for example, with a screw by use of a torque wrench at a torque of 4 kg, and the distance of the ends of the holder from the reference plane is measured. In a state of the holder placed to be set free on the reference plane, the distance of the holder ends from the reference plane is preferably in the range from 0.02 to 0.1 mm.

To improve the precision of the warpage dimension of the holder, the flatness of the flat holder before warping convexly or concavely and the repeat accuracy of the warpage should be improved. The accuracy of the flatness of the flat holder depends on the setting of the leveler before the warping step, the pressing degree, the pressing speed, and setting of the sink spring of the mold, and the like factors.

The degree of the warpage of the rubber elastomer blade at its tip portion depends on the molding temperature and the properties of the material such as the filler content, and the crosslinking density of the rubber, since warpage is caused by the difference of the linear expansion coefficient between the rubber elastomer and the holder. The higher the mold temperature, the larger the warpage of the rubber, whereas the lower the mold temperature, the smaller the warpage. Also, a larger filler content in the rubber decreases the warpage, and a higher crosslinking density decreases the warpage.

For flattening the tip portion of the rubber elastomer blade, the degree of warpage of the holder should be selected in correspondence with the warpage of the rubber elastomer blade itself. The warpage of the rubber elastomer blade depends also on its shape. For example, the longer the thin tip portion of the rubber elastomer blade, the larger the warpage, whereas the shorter the thin tip portion, the smaller the warpage. Also, a larger slanting angle of the slanting face causes a larger warpage, and a larger thickness of the tip portion decreases the warpage. In addition, the warpage direction of the separated rubber elastomer blade itself is reverse to that of the rubber elastomer bonded to the holder.

The degree of warpage of the rubber elastomer blade also depends on the molding method, since the internal strain and packing density of the rubber varies depending on the molding method, such as high-speed injection molding, and low-speed casting into a split mold.

In another embodiment of the present invention, the holder may be warped by holder fixation to the designed position in the development device. For example, the holder, which has risings at both its ends in an unfixed free state at the fixation position in the development device, is warped by fixation to the designed points in the direction opposite to the end rising direction to decrease the warpage of the rubber elastomer blade at the face of the pressure contact portion.

Figure 7:
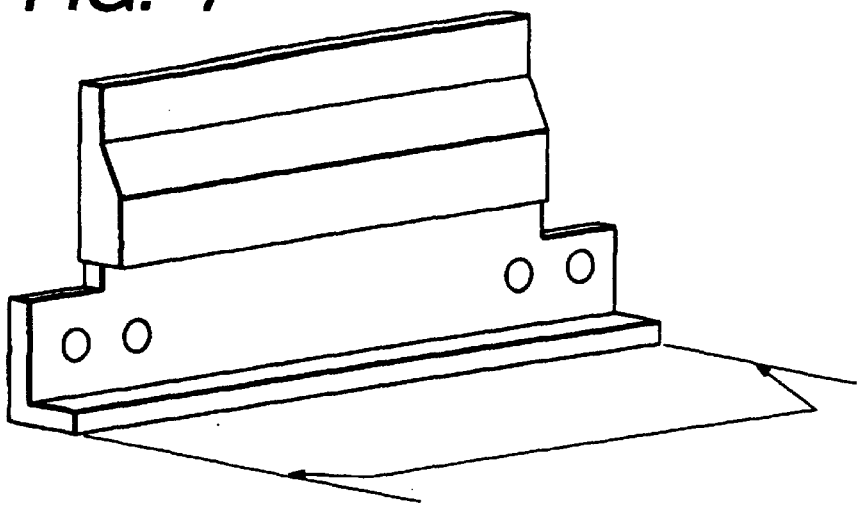
FIG. 7 is a perspective view of a developer-regulating member of the present invention.
Figure 8:
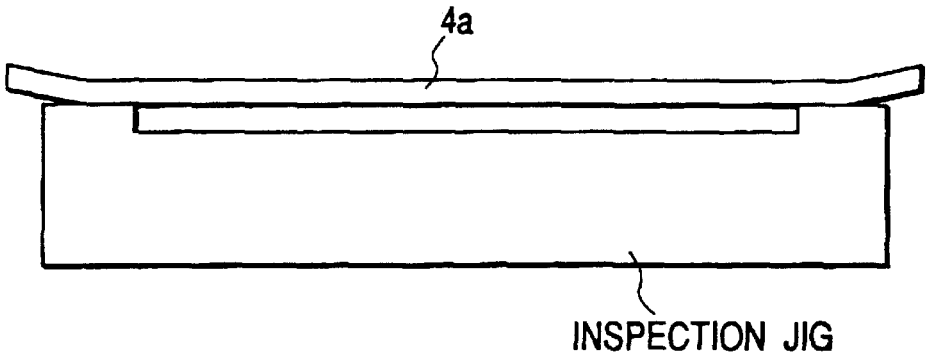
FIG. 8 shows a state of a developer-regulating member of the present invention place without screw fixation on an inspection jig.
Figure 9:
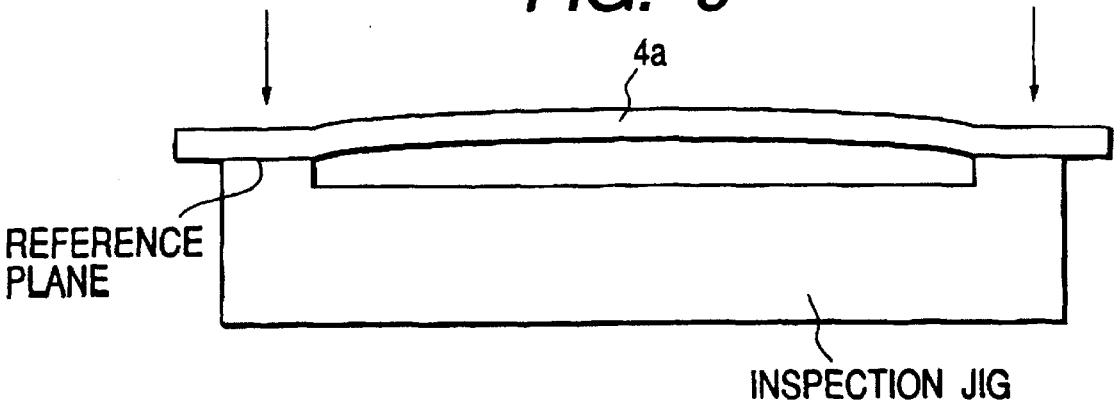
FIG. 9 shows a state of a developer-regulating member of the present invention screwed onto an inspection jig.

For example, such a developer-regulating member has rising end portions as shown in FIGS. 7 and 8. When it is fixed to an inspection jig of the same shape as the fixing position of the development device as shown in FIG. 9, the entire holder is warped concavely relative to the pressure contact portion of the rubber elastomer blade. (In FIG. 9, the rubber elastomer blade is brought into pressure contact at the upper side face with the developer-feeding member.) As a result, with this warped holder, the flatness of the pressure contact portion of the rubber elastomer blade is improved in the same manner as the developer-regulating member shown in FIG. 1 employing the concavely worked holder. With the developer-regulating member mentioned before, the concave warpage varies to some extent on the fixation, and the degree of warping should be decided in consideration of this warpage variation. On the other hand, with this developer-regulating member, the warpage of the fixed holder can be directly controlled and the flatness can be controlled more satisfactorily to obtain a stable image. It is not necessary to increase the working steps for preparation of this holder, which is advantageous in the production cost.

The above-mentioned developer-regulating member is improved in the flatness of the pressure contact portion of the rubber elastomer blade by the aforementioned effect. Therefore, the shape of the holder, namely the direction and the extent of the rise at both ends of the holder is decided so that the pressure contact portion becomes flat when the developer-regulating member is fixed to the development device. In this specification, the term "flat" means a state of the pressure contact face of the rubber elastomer blade such that the developer is pressed uniformly against the developer-feeding member so as not to cause image density irregularity.

The developer-regulating member shown in FIG. 7 has a tapered face at the side reverse to the pressure contact side of the rubber elastomer blade. With such a member, both end portions of the holder are made to rise toward the face of pressure contact to flatten the pressure contact portion of the rubber elastomer blade.

The working for the above holder can be conducted as follows. A slitted roll material is leveled in a roll lengthwise direction by a leveler, and is punched. The leveled and punched material is bent at the end portion, and then is bent. In this embodiment, the bending of the ends in the breadth direction is conducted by a downward bending system. The mold cavity has the shape of the rise portions at both ends, so that the both end rise and the warpage are simultaneously formed. The degree of the rise at both ends is controlled by the worked dimension of the mold employed in the downward warping in the breadth direction. In the case where the warping in the breadth direction is conducted by a V-bending, the rise portion is provided similarly in the cavity of the V-warpage mold. The degree of the rise is decided by the dimension of the V-type mold.

The holder having the rising ends becomes concave when screwed to a holder measurement jig for measuring the shape on fixation to the development device (FIG. 9), and is flat in an unscrewed free state (FIG. 8). The degree of warpage of the holder screwed on the fixing jig depends on the angle and position of the rising at both ends. A larger rising angle (degree of rising) causes larger warpage on screw fixation, whereas a smaller rising angle causes smaller warpage. The position of the rising at both ends (beginning position of the rising) is preferably near the face to be screwed of the development device. With the rising position at the inner side of the holder, the warpage of the holder is larger, whereas with the position at the outer side, the warpage is smaller.

The angle of the rising, and the position of the rising at both ends of the holder are selected suitably in accordance with the shape and molding conditions of the rubber elastomer blade. For example, the warpage is measured for a rubber elastomer blade molded integrally with a holder having no rise of the ends, and therefrom the direction and degree of the rising of the holder are decided. Otherwise, the dependence of the degree of warpage of the rubber elastomer blade on the rising angle and the rising position is derived experimentally, and therefrom the holder is designed, or from the result of computer simulation, the holder is designed.

The degree of the warpage on fixation to a development device can be changed by changing the rising angle and the rising position at both end portions of the holder. Insufficient warpage of the holder may not correct sufficiently the resulting warpage of the rubber elastomer blade tip, whereas excessive warpage of the holder may cause deformation of the developer vessel owing to the shape of the holder mounted thereon. Therefore, the rising angle and rising position of the holder should be selected respectively within the suitable range.

Figure 6:
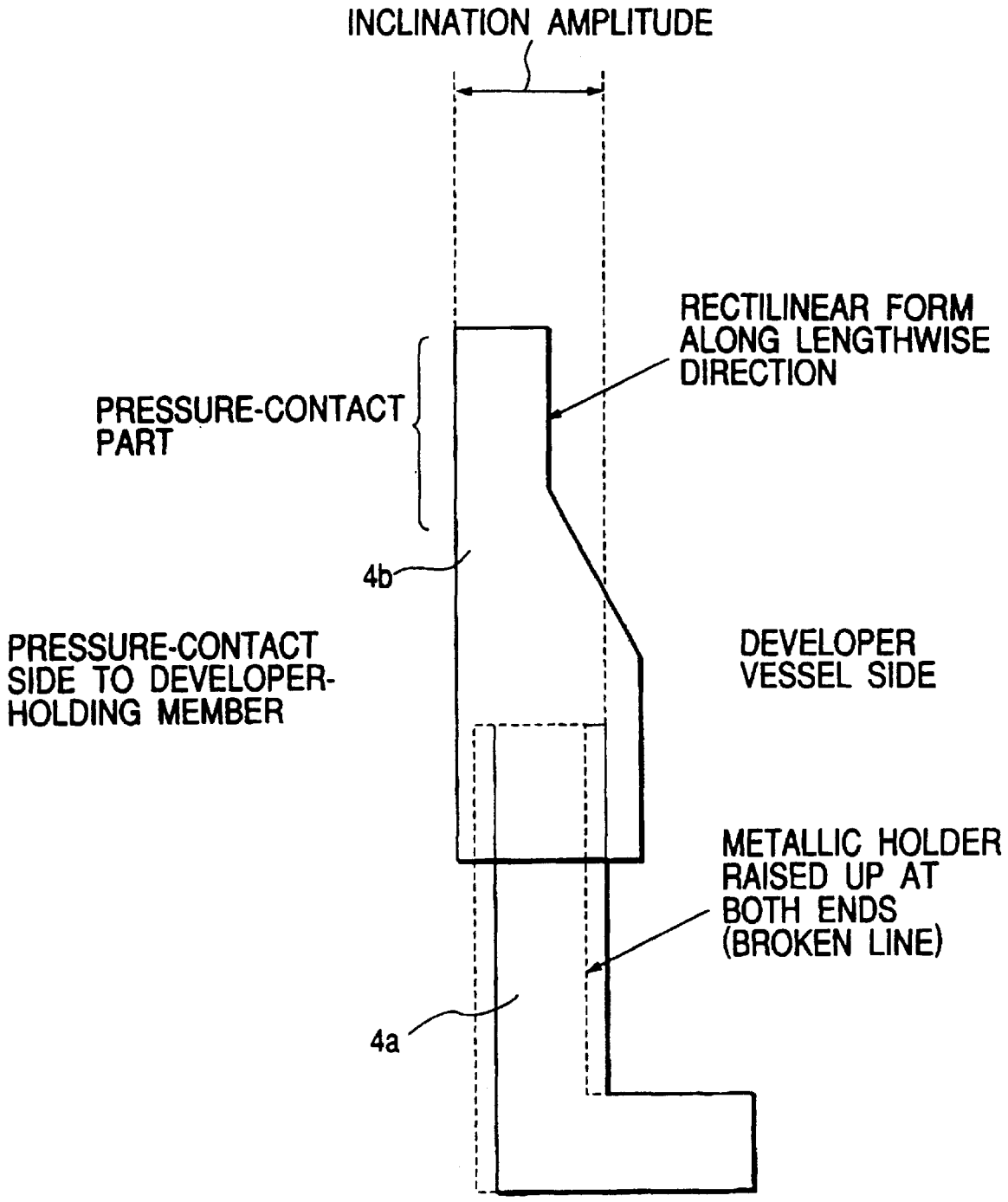
FIG. 6 shows a lateral side shape of a developer-regulating member of the present invention.

For example, with the developer-regulating member constituted of a metal holder of 250 mm and a rubber elastomer blade in a shape as shown in FIGS. 6 and 7, the rising angle and the rising position are selected so as to obtain warpage ranging preferably from 0.02 to 0.1 mm, and more preferably from 0.02 to 0.06 mm, when screwed on a development device.

In the invention described above, the portion of a rubber elastomer blade brought into pressure contact with a surface of a developer-feeding member is flattened for uniform pressure contact of the rubber elastomer blade.

Next, the invention is described in which the metal mold is worked to obtain a flat front end of the taper portion.

Figure 10:
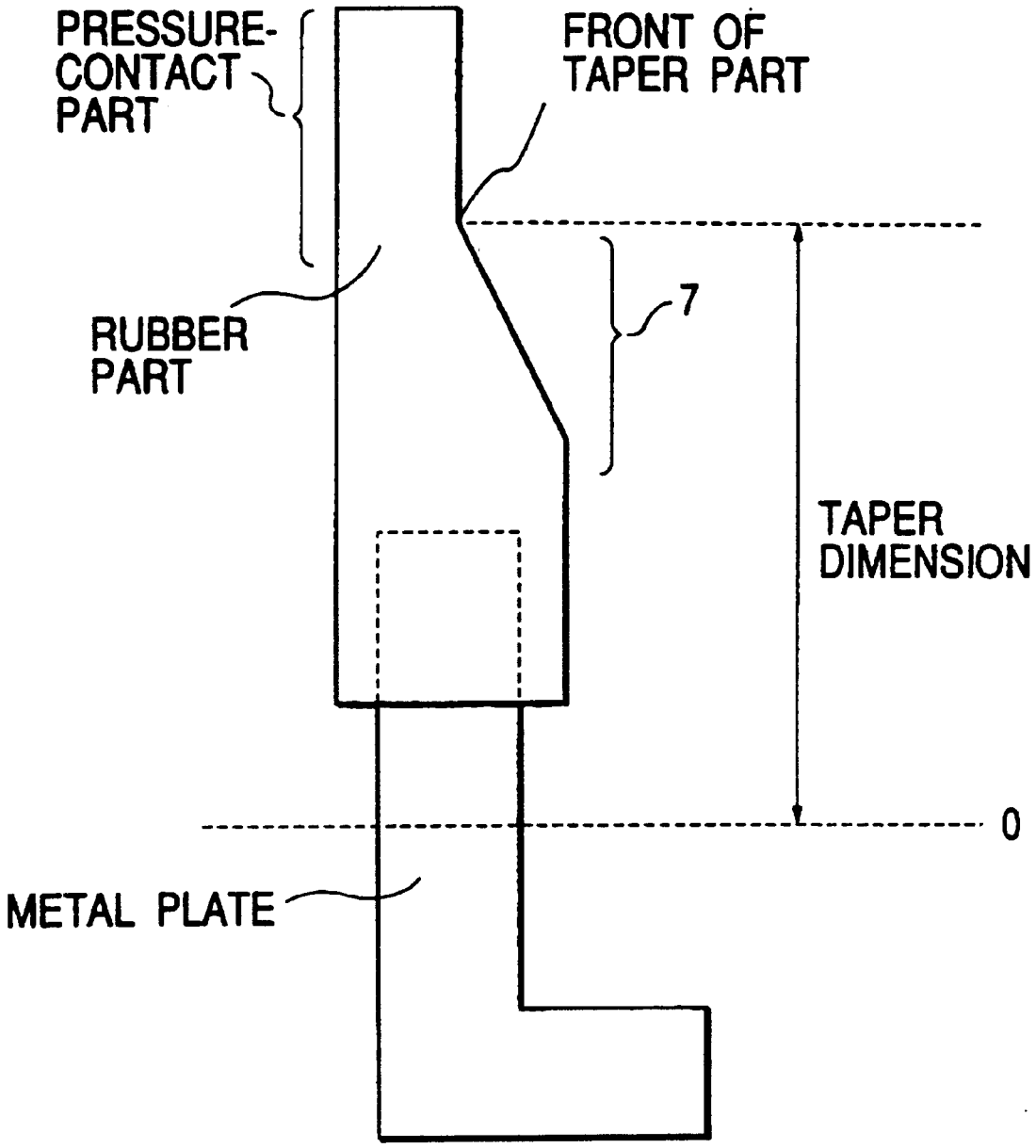
FIG. 10 shows the taper dimension of the developer-regulating member.
Figure 13:
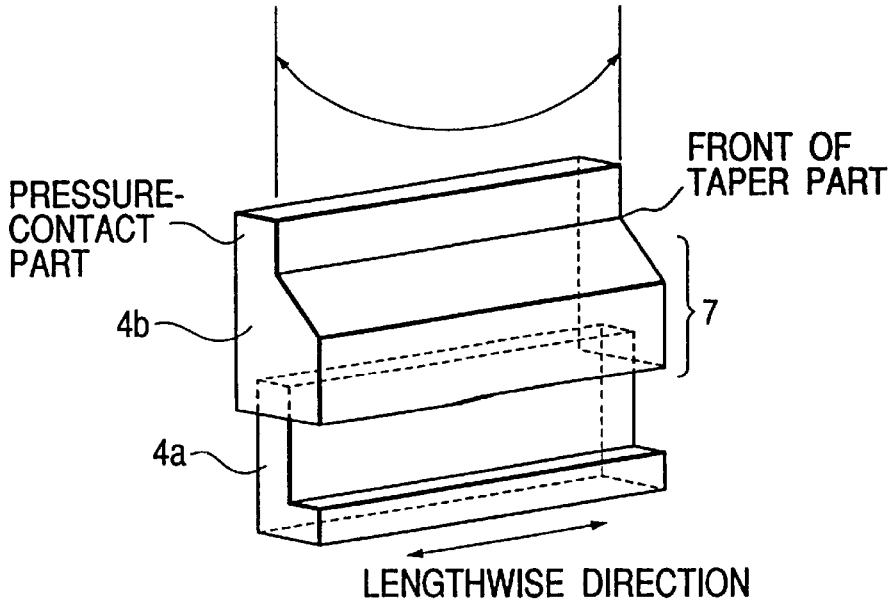
FIG. 13 PRIOR ART
FIG. 13 shows deformation of a taper portion of a conventional developer-regulating member.

This invention provides a process for producing a developer-regulating member having a taper portion. The term "taper portion" refers to a portion of a developer-regulating member in which the thickness of the rubber elastomer blade changes in the direction perpendicular to the lengthwise direction of the blade (FIG. 13). This taper portion facilitates the control of contact pressure at the pressure contact portion (the portion of the rubber elastomer blade brought into pressure contact with a developer-feeding member). The term "taper length" in the present invention refers to measure of the length of the taper portion, and is the distance from a reference level (0) suitably provided in a direction parallel to the lengthwise direction to the front portion of the thickness decreasing portion (FIG. 10).

Figure 11:
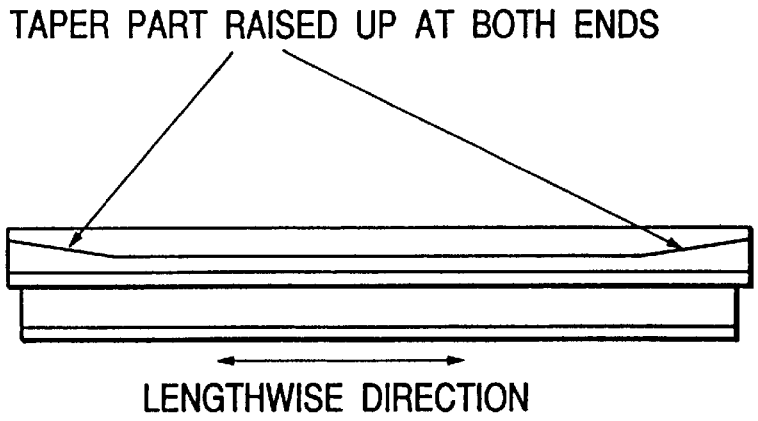
FIG. 11 PRIOR ART
FIG. 11 shows a shape of a conventional developer-regulating member.
Figure 12:
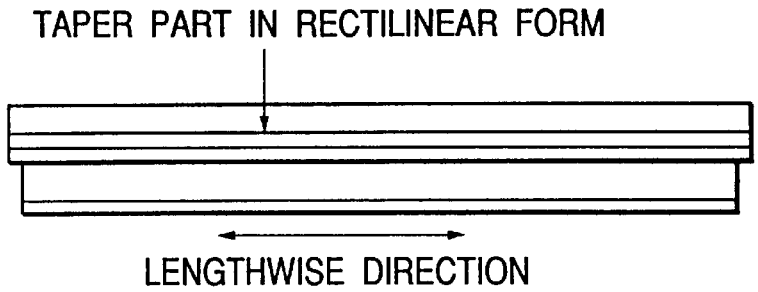
FIG. 12 shows a shape of a developer-regulating member of the present invention.

The process for producing the developer-regulating member of the present invention is described below. In a conventional process, the metal mold has a molding cavity having a straight face for the front portion of the taper portion, so that the molded rubber elastomer blade becomes concave with both ends rising (FIGS. 13 and 11). FIG. 11 shows the shape of the member of FIG. 13 viewed from the right side. On the other hand, in the process of the present invention, the metal mold face for both ends of the front of the taper portion of the rubber elastomer blade is sunk in the direction reverse to the rising direction, whereby the warpage after the molding is canceled by the sinking to flatten the front portion of the taper portion of the molded product. In other words, in the metal mold, the taper length is made preliminarily to be shorter at both ends than that at the middle portion in the lengthwise direction. As a result, the taper length is substantially uniform over the entire range in the lengthwise direction (FIG. 12).

The working of the metal mold for the taper shape can be conducted by electrical discharge machining. By the usually conducted grinding machining, the cavity portion cannot be selectively carved, and an insert should be employed. However, when using the insert, a gap is formed at the insert portion in the metal mold to cause burr after the post-working of the molded article. Therefore, electrical discharge machining is suitable. In electrical discharge machining, for example, an electrode in an intended product shape is formed by cutter machining of an electrode material such as copper, and a metal mold (cavity) is formed, in a taper shape, by applying high-voltage current to melt the mold material at 1000° C. or higher. Even by electrical discharge machining, some machining error and measurement error can arise. This is because the corner portions are melted and lost by the high temperature, even though the electrode is used only once, not reused, and the electrode and the article are not brought into contact with each other. Specifically, the corner portion (convex portion) tends to be melted to become unsharp. For example, at the front of the taper portion, the allowable dimensional error is ±0.08 mm for the product, and 0.04 mm for working. For a longer article, several electrodes (three electrodes in the present examples) are used owing to the limitation of the discharge apparatus, which causes a larger error in the lengthwise direction.

The suitable dimension for the retraction of the molding face of the metal mold depends on the mold temperature, the properties of the molded material (the filler content in the rubber, the crosslinking density of the rubber, etc.) and the shape of the rubber elastomer blade as in the aforementioned setting of the warpage of the developer-regulating member of the present invention. Therefore, to make uniform the taper dimension of the rubber elastomer blade, the retraction in the metal mold at both ends should be decided in correspondence with the rise at the ends of the rubber elastomer blade itself without the holder, and the metal mold should be finished with a dimension suitable for the molding temperature and the material. For example, in molding a silicon rubber with a metal mold at 180° C., the retraction dimension at both ends of the metal mold, namely the difference of the retraction in the metal mold between the center portion and the end potion, is preferably in the range from 0.01 to 0.2 mm for the dimension of 30 mm at the end in the lengthwise direction.

The tape dimension of the molded face can be decided on the basis of an experimentally derived relation between the taper dimension at the ends in the metal mold and that at the ends of the molded rubber blade. Otherwise, it can be decided according to the result of a computer simulation. Thus, by suitable setting of the retraction in the mold, the defects of density irregularity and white streaks of the printed image can be prevented. The term "substantially uniform" means that the pressure applied to the toner (developer) to press it against the developer-feeding member is uniform so as not to cause image density irregularity.

The holder in the present invention is formed out of a heat-resistant corrosion-resistant material, such as a zinc-coated steel plate, a zinc-lite steel plate, a silver-alloy steel plate, a stainless steel plate, a phosphor bronze plate, an aluminum plate, and a heat-resistant resin plate. Of these, the metallic holder material is preferred in view of its rigidity and heat resistance. The thickness of the holder plate ranges from 0.1 to 5 mm, and is usually from 1.2 to 1.6 mm .The rubber material for the rubber elastomer blade is a rubber elastomer, such as liquid silicone rubber, silicone rubber produced by Mirable Co., polyurethane rubber, and modified products and blend thereof.

In molding the rubber elastomer and the metal holder in integration, a thermal adhesion primer for silicone rubber may be used for strengthening the adhesion of less adherent silicone rubber or the like.

Next, the development device is explained below which employs the elastic blade of the present invention as the developer-regulating member.

Figure 4:
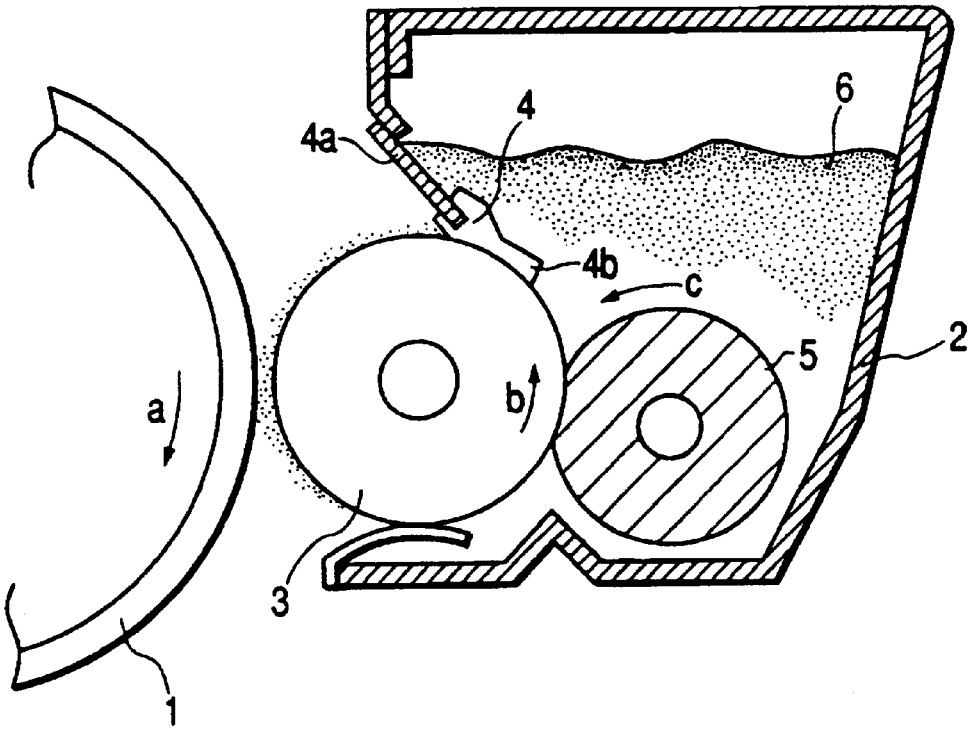
FIG. 4 shows schematically a development device of the present invention.

FIG. 4 shows a constitution of an image-forming apparatus. The development device is provided with a development sleeve 3 opposing to a photosensitive member 1 which rotates in the direction shown by the arrow mark a to visualize an electrostatic latent image on the photosensitive member 1 as a toner image. The development sleeve 3 as shown in FIG. 2 enters the development vessel 2 with the right-side half periphery of the sleeve, and the left-side half periphery is exposed outside to oppose to the photosensitive member 1 and to rotate freely. A small gap is provided between the development sleeve 3 and the photosensitive member 1. The development sleeve 3 is driven to rotate in the direction shown by the arrow mark b relative to the rotation direction a of the photosensitive member 1 in the drawing.

In the development vessel 2, an elastic blade 4 of the present invention is provided at the upper side of the development sleeve 3, and an elastic roller 5 is provided to be in contact with the periphery of the development sleeve 3 before the contact line with the elastic blade 4 along the rotation direction of the development sleeve 3.

The elastic blade 4 is set downward-slantingly against the rotation direction of the development sleeve 3 to be in pressure contact with the upper periphery of the development sleeve 3.

The elastic roller 5 is brought into contact with the development sleeve 3 at the side of the development sleeve reverse to the photosensitive member 1, and is supported rotatably.

In the development device having the constitution as above, the elastic roller 5 rotates in the direction indicated by the arrow mark c to feed the toner 6 to the vicinity of the development sleeve 3. At the contact portion (nip portion) of the development sleeve 3 with the elastic roller 5, the toner 6 on the elastic roller 5 is transferred and adheres to the development sleeve 3 by friction with the development sleeve 3.

Thereafter, with the rotation of the development sleeve 3, the toner 6 adhering onto the development sleeve 3 is carried to the contact portion between the elastic blade 4 and the development sleeve 3. On passing through the contact portion, the toner is rubbed by the surface of the development sleeve 3 and the elastic blade 4 to be frictionally electrified sufficiently.

The toner 6 electrified as above leaves the contact portion between the elastic blade 4 and the development sleeve 3 to form a thin layer of the toner 6 on the development sleeve 3, and is delivered to the developing portion of the development sleeve 3 opposing to the photosensitive member 1 at a small gap. By application of an alternate voltage formed by superposing a DC voltage onto an AC voltage, the toner 6 on the development sleeve 3 is transferred onto the photosensitive member 1 in correspondence with the latent image to adhere thereto and to visualize the latent image as a toner image.

The toner 6 remaining unconsumed on the development sleeve 3 in the developing portion is conveyed by rotation of the development sleeve 3 into the developer vessel 2.

The recovered toner 6 is stripped off by the elastic roller 5 brought into contact with the development sleeve 3. Simultaneously, with the rotation of the elastic roller 5, a replenishing toner is supplied onto the development sleeve 3. The replenished toner 6 is again delivered to the pressure contact portion between the development sleeve 3 and the elastic blade 4.

Most part of the toner 6 stripped off from the development sleeve 3 is conveyed and mixed with the toner 6 in the developer vessel 2 with the rotation of the elastic roller 5, thereby dispering the electric charges of the stripped toner 6.

The useful toner includes magnetic toners and non-magnetic color toners, and has preferably an average particle diameter in the range of from 3 to 15 $\mu$m.

Figure 5:
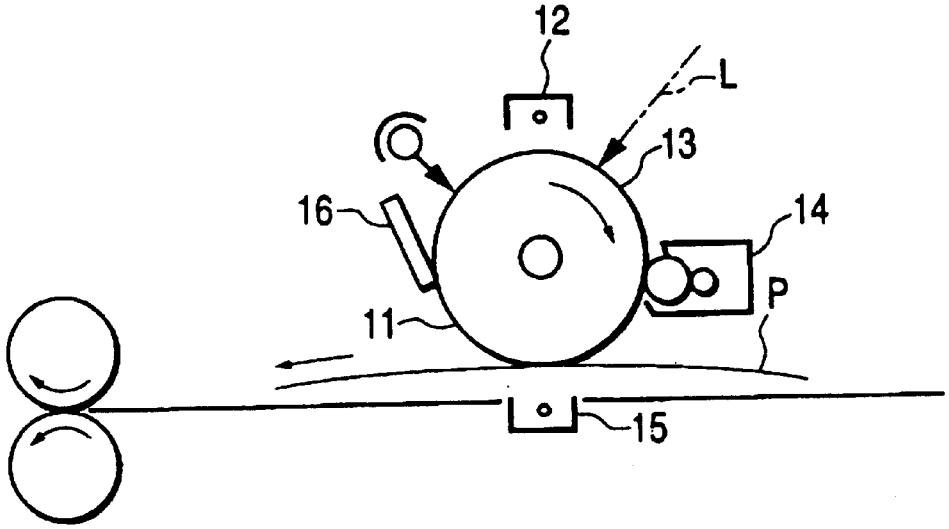
FIG. 5 shows schematically an electrophotographic apparatus employing the developer-regulating member of the present invention.

FIG. 5 illustrates the construction of an electrophotographic apparatus employing the development device of the present invention. This device has a photosensitive member 11 as an electrifiable electrophotographic sensitive member which comprises an electroconductive supporting member made of aluminum or the like and a photosensitive layer formed on the peripheral face thereof as the basic constitutional layer. The photosensitive member rotates around a supporting axis at a prescribed peripheral speed clockwise as shown in the drawing.

An electrifying member 12, a corona discharger, is provided in opposition to the surface of the photosensitive member 11 for primary electrification and electrifies primarily the photosensitive member face at a prescribed polarity and a prescribed potential uniformly.

The surface of the photosensitive member 11 having been electrified uniformly by the electrifying member 12 is then exposed to desired image information light (laser beam light scanning, slit exposure to an original image, and so forth) given by the light exposure means L. Thereby, an electrostatic latent image 13 is formed on the peripheral surface in correspondence with the intended image information. The latent image is successively visualized as a toner image by a development device 14.

The toner image is transferred onto a transfer-receiving material P delivered synchronously with the rotation of the photosensitive member 11 from a paper-feeding means (not shown in the drawing) to a toner transfer portion between the photosensitive member 11 and a toner image transfer means 15. In this example, the transfer means 12 is a corona electrifier, and the toner image is transferred onto a transfer-receiving medium P by electrification to polarity opposite to the toner from the reverse face of the transfer-receiving medium.

The transfer-receiving medium P having the toner image 19 separated from the surface of the photosensitive member 11 and is sent to a hot fixing roll 18 to have the toner image fixed thereon, and is discharged as an image copy.

The surface of the photosensitive member 11 after the toner image transfer is cleaned by a cleaning means 16 to remove remaining toner and other adhering matter, and employed for image formation repeatedly.

Two or more of the aforementioned constituting elements including the photosensitive member, the electrifying means, the developing device, and the cleaning means may be integrated into a process cartridge. As a result, the process cartridge can be made demountable from the main body of the apparatus. For example, a photosensitive member, a development device, and optionally an electrifying means and a cleaning means are integrated into a process cartridge so as to be demountable from the main body of an electrophotographic apparatus by aid of a guide means like a rail.

The development device of the present invention is useful in an electrophotographic apparatus such as copying machines, laser beam printers, LED printers, and electrophotographic engraving systems.

EXAMPLE 1

A warped metallic holder prepared from a zinc-coated steel plate of 1.6 mm thick and coated preliminarily with a primer (Z3042, produced by Bayer Co.) for use in silicone was placed in a heated metal mold. The metallic holder had a length of 250 mm, and had a warpage of +0.08 mm in a free state, and +0.05 mm in a clamped (fixed) state on a jig. The warpage was concave relative to the pressure contact face as shown by the arrow mark at the lower portion of FIG. 1. The warpage was obtained, as shown in FIG. 9, by measuring a position of the middle portion of the metallic holder on the bases of the reference level (or plane), with a positive value showing a position higher than the reference level. With this metallic holder, LTV silicone rubber L (trade name LSR AI3601, produced by Bayer Co.) was injection-molded in integration by means of an LSR injection molding machine (Model 520C, manufactured by Arburg Co. ) at 180° C. for 40 seconds. Then the molded matter was heat-treated at 200° C. for one hour to obtain a developer-regulating member having a rubber elastomer blade of a hardness of 40° (measured according to JIS A-K6253). The inclination at the tip portion of the rubber elastomer blade was measured (the warpage shown by the arrow in the upper portion of FIGS. 1 and 2). The obtained developer-regulating member was set in a cartridge having a built-in development device. An image formation test was conducted with this cartridge, and the formed image was evaluated.

Comparative Example 1

A flat metallic holder prepared from a zinc-coated steel plate of 1.6 mm thick coated preliminarily with a primer (Z3042, produced by Bayer Co.) for use in silicone was placed in a heated metal mold. The metallic holder had a warpage of +0.01 mm in a free state, and −0.02 mm in a clamped state on a jig. With this metallic holder, LTV silicone rubber (trade name LSR AI3601, produced by Bayer Co.) was injection-molded in integration by means of an LSR injection molding machine (Model 520C, manufactured by Arburg Co.) at 180° C. for 40 seconds. Then the molded matter was heat-treated at 200° C. for one hour to obtain a developer-regulating member having a rubber elastomer blade of a hardness of 40°. The inclination (warpage) at the tip portion of the rubber elastomer blade was measured. The obtained developer-regulating member was set in a cartridge having a built-in development device. An image formation test was conducted with the cartridge, and the formed image was evaluated.

Comparative Example 2

A warped metallic holder prepared from a zinc-coated steel plate of 1.6 mm thick coated preliminarily with a primer (Z3042, produced by Bayer Co.) for use in silicone was placed in a heated metal mold. The warpage of the metallic holder was −0.07 mm in a free state, and −0.04 mm in a clamped state on a jig. The warpage was concave relative to the pressure contact face as shown by the arrow mark at the lower portion of FIG. 1. With this metallic holder, LTV silicone rubber (trade name LSR AI3601, produced by Bayer Co.) was injection-molded in integration by means of an LSR injection molding machine (Model 520C, manufactured by Arburg Co.) at 180° C. for 40 seconds. Then the molded matter was heat-treated at 200° C. for one hour to obtain a developer-regulating member having a rubber elastomer blade of a hardness of 40°. The warpage at the tip portion of the rubber elastomer blade was measured. The obtained developer-regulating member was set in a cartridge having a built-in development device. An image formation test was conducted with the cartridge, and the formed image was evaluated.

Figure 3:
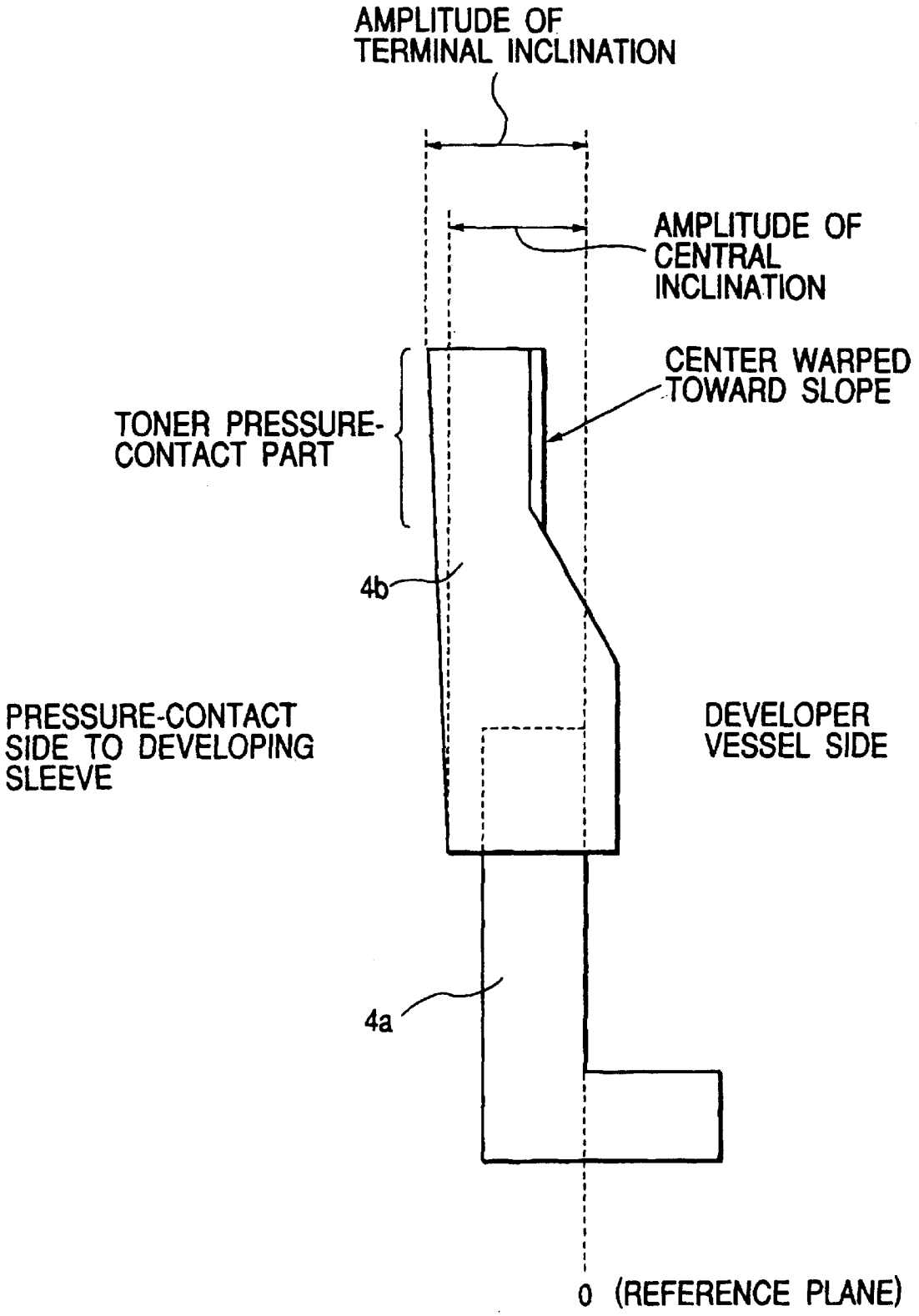
FIG. 3 shows a lateral side shape of a developer-regulating member.

The warpage at the tip portion is represented by the difference between the inclination length (or amplitude) at the middle portion in the lengthwise direction and the inclination length at the end portion of the rubber elastomer blade (FIG. 3).

Table 1 shows the shapes of the metallic holders, the shapes of the developer-regulating members, and the results of the evaluation of the formed images of Example 1 and Comparative Examples 1 and 2.

As shown in Table 1, in Example 1, the convexly warped metallic holder makes flat the entire tip portion of the rubber elastomer blade, making uniform the toner pressing force against the development sleeve. Thereby, an excellent image was formed in the image formation test with a practical copying machine. On the other hand, in Comparative Example 1, a flat metallic holder was used as the insert holder, which gave a lower contact pressure at the middle portion in the lengthwise direction than that at the end portions, resulting in a slightly low image density, and slight white streaks in the middle portion in the image evaluation. In Comparative Example 2, the concave metallic holder employed makes convex the middle portion of the tip of the rubber elastomer blade to cause significant image density irregularity and significant white streaks in the image evaluation.

EXAMPLE 2

A metallic holder having a rise at both ends (15 mm) was made of a zinc-coated steel plate of 1.6 mm thick and WBS coated preliminarily with a primer (Z3042, produced by Bayer Co.) for use in silicone. This metallic holder was placed in a heated metal mold. The rise at the ends of the holder was as follows in terms of flatness: −0.01 mm in a free state, and +0.05 mm in a clamped state on a jig. The direction of the rise was as shown by the arrow mark in the lower portion of FIG. 10. With this metallic holder, LTV silicone rubber (trade name LSR AI3601, produced by Bayer Co.) was injection-molded in integration by means of an LSR injection molding machine (Model 520C, manufactured by Arburg Co.) at 180° C. for 40 seconds. Then the molded matter was heat-treated at 200° C. for one hour, obtaining a developer-regulating member having a rubber elastomer blade of a hardness of 40°. The warpage at the tip portion of the rubber elastomer blade was measured. The obtained developer-regulating member was set in a process cartridge having a built-in development device. An image formation test was conducted with the cartridge, and the formed image was evaluated.

Comparative Example 3

A flat metallic holder prepared from a zinc-coated steel plate of 1.6 mm thick and coated preliminarily with a primer (Z3042, produced by Bayer Co.) for silicone was placed in a heated metal mold. The metallic holder had a warpage of −0.03 mm in a free state, and −0.01 mm in a clamped state on a jig. With this metallic holder, LTV silicone rubber (trade name LSR AI3601, produced by Bayer Co.) was injection-molded in integration by means of an LSR injection molding machine (Model 520C, manufactured by Arburg Co.) at 180° C. for 40 seconds. Then the molded matter was heat-treated at 200° C. for one hour to obtain a developer-regulating member having a rubber elastomer blade of hardness of 40°. The warpage at the tip portion of the rubber elastomer blade was measured. The obtained developer-regulating member was set in a cartridge having a built-in development device. An image formation test was conducted with the cartridge, and the formed image was evaluated.

EXAMPLE 3

A warped metallic holder prepared from a zinc-coated steel plate of 1.6 mm thick and coated preliminarily with a primer (Z3042, produced by Bayer Co.) for silicone was placed in a heated metal mold. The metallic holder had a warpage of +0.09 mm in a free state, and +0.05 mm in a clamped state on a jig. The direction of the warpage was as shown by the arrow mark in the lower portion of FIG. 1, and concave relative to the pressure contact face. With this metallic holder, LTV silicone rubber (trade name LSR AI3601, produced by Bayer Co.) was injection-molded in integration by means of an LSR injection molding machine (Model 520C, manufactured by Arburg Co.) at 180° C. for 40 seconds. Then the molded matter was heat-treated at 200° C. for one hour to obtain a developer-regulating member having a rubber elastomer blade of hardness of 40°. The inclination at the tip portion of the rubber elastomer blade was measured. The obtained developer-regulating member was set in a cartridge having a built-in development device. An image formation test was conducted with the cartridge, and the formed image was evaluated.

Table 2 shows the shapes of the metallic holders, the shapes of the developer-regulating members, and the results of the evaluation of the formed images of Examples 2 and 3, and Comparative Example 3.

As shown in Table 2, in Example 2, the metallic holder having rises at the ends makes uniform the rubber tip dimension over the entire region of the blade, making uniform the toner pressing force against the development sleeve. By this arrangement, an excellent image was formed in the image formation test with a practical copying machine. On the other hand, in Comparative Example 3, a flat metallic holder was used as the insert holder, which gave a higher contact pressure at the middle portion in the lengthwise direction than that at the end portions, resulting in a slightly low image density, and slight white streaks in the center portion of the formed image. In Example 3, the convex metallic holder was employed, whereby less warpage of the rubber elastomer blade, was caused by contraction of the rubber, giving an excellent image. However, the developer vessel was made of a resin which was less rigid, so that the rubber elastomer blade became slightly concave at the middle portion of the blade tip owing to the convex shape of the metallic holder. By this arrangement, slight irregularity of the image density was caused when the member was set in the developmemt device, but it caused no problem practically.

EXAMPLE 4

A metal mold was prepared by electrical discharge machining of the molding face, in which the molding face of the metal mold was retracted slantly by 0.1 mm over the range of 30 mm from the end corresponding to both ends of the front portion of the taper (in Table 1, this retraction is shown as "−0.1 mm). Specifically, the metal mold was machined to form the taper portion of the mold with slant retraction in the direction reverse to that shown by the arrow in FIG. 13. This metal mold was heated. Therein placed was a metallic holder prepared from a zinc-coated steel plate of 1.6 mm thick and coated preliminarily with a primer (Z3042, produced by Bayer Co.) for use in silicone. With this metallic holder, LTV silicone rubber (trade name LSR AI3601, produced by Bayer Co.) was injection-molded in integration by means of an LSR injection molding machine (Model 520C., manufactured by Arburg Co.) at 180° C. for 40 seconds. Then the molded matter was heat-treated at 200° C. for one hour, obtaining a developer-regulating member having a rubber elastomer blade of hardness of 40°. The dimension of the taper was measured by microscopy. The developer-regulating member was set in a cartridge having a built-in development device. An image formation test was conducted with the cartridge, and the formed image was evaluated.

Comparative Example 4

A metal mold was prepared in which the molding face is machined rectilinearly by electrical discharge, obtaining uniform taper dimension over the lengthwise direction of the rubber elastomer blade. This metal mold was heated. Therein placed was a metallic holder prepared from a zinc-coated steel plate of 1.6 mm thick and coated preliminarily with a primer (Z3042, produced by Bayer Co. ) for use in silicone. With this metallic holder, LTV silicone rubber (trade name LSR AI3601, produced by Bayer Co.) was injection-molded in integration by means of an LSR injection molding machine (Model 520C, manufactured by Arburg Co.) at 180° C. for 40 seconds. Then the molded matter was heat-treated at 200° C. for one hour to produce a developer-regulating member having a rubber elastomer blade of hardness of 40°. The dimension of the taper of the rubber elastomer blade was measured by microscopy. The developer-regulating member was set in a cartridge having a built-in development device. An image formation test was conducted with the cartridge, and the formed image was evaluated.

Comparative Example 5

A metal mold was prepared by electrical discharge machining of the molding face, in which the molding face of the metal mold was retracted slantly by 0.2 mm over the range of 30 mm from the end corresponding to both ends of the front portion of the taper. Specifically, the metal mold was machined to form the taper portion of the mold with slant rise in the direction shown by the arrow in FIG. 13. This metal mold was heated. Therein placed was a metallic holder prepared from a zinc-coated steel plate of 1.6 mm thick and coated preliminarily with a primer (Z3042, produced by Bayer Co.) for silicone. With this metallic holder, LTV silicone rubber (trade name LSR AI3601, produced by Bayer Co.) was injection-molded in integration by means of an LSR injection molding machine (Model 520C, manufactured by Arburg Co.) at 180° C. for 40 seconds. Then the molded matter was heat-treated at 200° C. for one hour to obtain a developer-regulating member having a rubber elastomer blade of a hardness of 40°. The dimension of the taper was measured by microscopy. The developer-regulating member was set in a cartridge having a built-in development device. An image formation test was conducted with the cartridge, and the formed image was evaluated.

Comparative Example 6

A metal mold was prepared by electrical discharge machining of the molding face, in which the molding face of the metal mold was retracted slantly by 0.3 mm over, the range of 30 mm from the end corresponding to both ends of the front portion of the taper. Specifically, the metal mold was machined to form the taper portion of the mold with slant rise in the direction shown by the arrow in FIG. 13. This metal mold was heated. Therein placed was a metallic holder prepared from a zinc-coated steel plate of 1.6 mm thick and coated preliminarily with a primer (Z3042, produced by Bayer Co.) for silicone. With this metallic holder, LTV silicone rubber (trade name LSR AI3601, produced by Bayer Co. ) was injection-molded in integration by means of an LSR injection molding machine (Model 520C, manufactured by Arburg Co. ) at 180° C. for 40 seconds. Then the molded matter was heat-treated at 200° C. for one hour to produce a developer-regulating member having a rubber elastomer blade of hardness of 40°. The dimension of the taper was measured by microscopy. The developer-regulating member was set in a cartridge having a built-in development device. An image formation test was conducted with the cartridge, and the formed image was evaluated.

Table 3 shows the shapes of the metallic holders, the shapes of the developer-regulating members, and the results of the evaluation of the formed images of Example 4 and Comparative Examples 4 to 6.

As shown in Table 3, in Example 4, the developer-regulating member molded with a metal mold having the molding face retracted by −0.1 mm over the ranges of 30 mm from the ends makes uniform the rubber tip dimension over the entire region of the blade, making uniform the toner pressing force against the development sleeve. Thereby, an excellent image was formed in the image formation test with a practical copying machine. On the other hand, in Comparative Example 4, the rubber elastomer was molded with a metal mold having the taper portion in a rectilinear shape, so that the rubber blade had rises at the taper portion at both ends in the lengthwise direction, which gave a higher contact pressure at the end portions in the lengthwise direction, resulting in a slightly low image density, and slight white streaks in the end portions of the formed image. In Comparative Example 5, the retraction of molding face at the both the ends was excessive, resulting in retraction of the rubber blade at both ends to cause insufficient triboelectrification and slightly lower image density. In Comparative Example 6, the rubber blade is retracted similarly as in Comparative Example 6, but the retraction was larger, resulting in remarkably lower image density at the end portions of the image.

TABLE 1

| | | Example | Comparative Example | |
|---|---|---|---|---|
| | | 1 | 1 | 2 |
| Shape of metallic holder | | | | |
| (Concave at middle portion) | (free) | +0.08 mm | +0.01 mm | −0.07 mm |
| | (clamped) | +0.05 mm | −0.02 mm | −0.04 mm |
| Warpage | | 0.01 mm | −0.06 mm | −0.12 mm |
| Image evaluation | | Good | Fair | Poor |

Note) Injection conditions: Injection time: 0.5 second, Injection pressure 1200 bar
Image evaluation: Evaluation of image density irregularity and white streaks, (Fair: slight irregularity but practically no problem)

TABLE 2

| | | Example 2 | Comparative Example 3 | Example 3 |
|---|---|---|---|---|
| Shape of metallic holder (both ends) | | End portion 15 mm Rise 0.02 mm | Flat | Convex |
| Flatness of metallic holder (convex in middle portion) | (Free) | −0.01 mm | −0.03 mm | +0.09 mm |
| | (Clamped) | +0.05 mm | −0.01 mm | +0.05 mm |
| Warpage | | +0.01 mm | −0.06 mm | +0.03 mm |
| Image evaluation | | Excellent | Poor | Fair |

Note) Injection conditions: Injection time: 0.5 second, Injection pressure 1200 bar
Image evaluation: Evaluation of image density irregularity and white streaks,

TABLE 3

| | Example | Comparative Example | | |
|---|---|---|---|---|
| | 4 | 4 | 5 | 6 |
| Retraction of molded blade | +0.01 to 0 mm | +0.09 to 0.1 mm | −0.1 to −0.09 mm | −0.2 to −0.19 mm |
| Shape of metal mold | | | | |
| Rise at end portion | −0.1 mm | No rise | −0.2 mm | −0.3 mm |
| Rise length from end | End 30 mm | | End 30 mm | End 30 mm |
| Image evaluation (End portion) | Good | Fair | Fair | Poor |

Note) Injection conditions: Injection time: 0.5 second, Injection pressure 1200 bar
Image evaluation: Evaluation of image density irregularity and white streaks, (Fair: slight irregularity but practically no problem)

What is claimed is:

1. A developer-regulating member comprising: a rubber elastomer blade to be pressed against the surface of a developer-feeding member; and a holder for holding the rubber elastomer blade, wherein the holder is warped convexly along the lengthwise direction when the pressing portion of the rubber elastomer blade warps concavely along the lengthwise direction, and wherein the holder is warped concavely along the lengthwise direction when the pressing portion of the rubber elastomer blade warps convexly along the lengthwise direction, thereby flattening the face of a part of the rubber elastomer blade, to be pressed against the surface of the developer-feeding member.

2. The developer-regulating member according to claim 1, wherein warping of the holder is caused when the holder is fixed to a set position in a development device.

3. The developer-regulating member according to claim 2, wherein the holder rises at both end portions in a free state at positions for fixation to the development device.

4. The developer-regulating member according to claim 1, wherein the rubber elastomer blade has a slant on a side reverse to the face pressed against the developer-feeding member to increase the thickness of the rubber elastomer blade toward a holder direction.

5. The developer-regulating member according to claim 1, wherein the warpage of the warped holder ranges from 0.02 mm to 0.1 mm.

6. The developer-regulating member according to claim 1, wherein the warpage of the warped holder ranges from 0.02 mm to 0.06 mm.

7. The developer-regulating member according to claim 1, wherein the rubber elastomer blade and the holder are integrated into one body.

8. The developer-regulating member according to claim 1, wherein the rubber elastomer blade is formed by injection molding.

9. The developer-regulating member according to claim 7 or 8, in combination with a process cartridge comprising a photosensitive member, and at least one of an electric charging device, a developing device, and a cleaning which are integrated into one body, wherein said process cartridge is demountable from the main body of the image-forming apparatus.

10. A development device comprising:

a developer vessel containing a developer;

a developer-feeding member for carrying the developer to a developing part; and a developer-regulating member pressed against a surface of the developer feeding member in its lengthwise direction with interposition of the developer to control the amount of the developer applied, wherein the developer-regulating member comprises:

a rubber elastomer blade to be pressed against the surface of the developer-feeding member; and a holder for holding the rubber elastomer blade, the holder being warped convexly along the lengthwise direction when the pressing portion of the rubber elastomer blade warps concavely along the lengthwise direction, and the holder is warped concavely along the lengthwise direction when the pressing portion of the rubber elastomer blade warps convexly along the lengthwise direction, thereby flattening the face of a part of the rubber elastomer blade, pressed against the surface of the developer-feeding member.

11. The development device according to claim 10, wherein warping of the holder is caused when the holder is fixed to a set position in a development device.

12. A process for producing a developer-regulating member comprising a rubber elastomer blade and a holder for holding the rubber elastomer blade in integration, with the thickness of the rubber elastomer blade being tapered in a direction perpendicular to the lengthwise direction, by injection molding with the holder placed in a metal mold, wherein a molding face of the metal mold for the rubber elastomer blade is designed to have a taper of a dimension smaller at both ends in the lengthwise direction than that of a middle portion, thereby forming the developer-regulating member with a substantially uniform taper dimension in the lengthwise direction.

13. A developer-regulating member produced by the process according to claim 12.

* * * * *

UNITED STATES PATENT AND TRADEMARK OFFICE

CERTIFICATE OF CORRECTION

PATENT NO. : 6,223,014 B1
DATED : April 24, 2001
INVENTOR(S) : Kentaro Niwano et al.

It is certified that error appears in the above-identified patent and that said Letters Patent is hereby corrected as shown below:

Column 1,
Line 9, "the" should read -- a --.
Line 10, "a thickness" should read -- the thickness --.
Line 28, "developer" should read -- developing --.

Column 2,
Line 55, "a" (first occurrence) should read -- the --.
Line 56, "the" should read -- a --.

Column 3,
Line 19, "include" should read -- includes --.

Column 4,
Line 11, "place" should read -- placed --.
Line 57, "of a" should read -- of an --.

Column 5,
Line 8, "an" should read -- and --.
Line 24, "and the" should read -- and --.
Line 27, "material" should read -- material, --.

Column 7,
Line 22, "obtain" should read -- obtain a --.
Line 42, "to" should read -- to a --.

Column 8,
Line 42, "tape" should read -- taper --.
Line 61, "mm .The" should read -- mm. The --.

Column 9,
Line 8 "opposing" should read -- opposed --.
Line 55, "opposing" should read -- opposed --.

Column 10,
Line 44, "to" (first occurrence) should read -- to a --.
Line 48, "19" should read -- is --.

UNITED STATES PATENT AND TRADEMARK OFFICE

CERTIFICATE OF CORRECTION

PATENT NO. : 6,223,014 B1
DATED : April 24, 2001
INVENTOR(S) : Kentaro Niwano et al.

It is certified that error appears in the above-identified patent and that said Letters Patent is hereby corrected as shown below:

Column 12,
Line 36, "WBS" should read -- was --.

Column 13,
Line 49, "blade," should read -- blade --.
Line 66, ""-0.1 mm)." should read -- "-0.1 mm"). --.

Column 15,
Line 1, "over," should read -- over --.
Line 43, "at the" should read -- at --.

Column 16,
Line 16, "streaks," should read -- streaks, (Fair: slight irregularity but practically no problem) --.
Line 36, "comprising: a" should read -- comprising: a --.

Column 17,
Line 7, "cleaning" should read -- cleaner --.

Signed and Sealed this

Fifth Day of March, 2002

*Attest:*

*Attesting Officer*

JAMES E. ROGAN
*Director of the United States Patent and Trademark Office*